United States Patent [19]

Ando et al.

[11] 4,142,131

[45] Feb. 27, 1979

[54] COLOR PICTURE TUBE

[75] Inventors: Kunio Ando, Mobara; Ryoichi Hirota, Yokohama; Kuniharu Osakabe, Mobara; Koichi Maruyama, Matsuzawa, all of Japan

[73] Assignee: Hitachi, Ltd., Tokyo, Japan

[21] Appl. No.: 760,122

[22] Filed: Jan. 17, 1977

[30] Foreign Application Priority Data

Nov. 12, 1975 [JP] Japan ..... 50-135062
Nov. 12, 1975 [JP] Japan ..... 50/135063

[51] Int. Cl.[2] ..... H01J 29/70; H01J 29/76

[52] U.S. Cl. ..... 315/368; 315/13 C; 313/412

[58] Field of Search ..... 315/13 C, 13 CG, 368, 315/370; 313/412

[56] References Cited

U.S. PATENT DOCUMENTS 2,907,915 10/1959 Gleichauf ..... 313/412
2,923,844 2/1960 Gundert ..... 313/412

FOREIGN PATENT DOCUMENTS 2224404 11/1972 Japan ..... 313/412
946527 1/1964 United Kingdom ..... 313/414

*Primary Examiner*—Maynard R. Wilbur
*Assistant Examiner*—T. M. Blum

[57] ABSTRACT

A color picture tube of an in-line type comprises means for deflecting beams of electron emitted from electron guns of the in-line type aligned horizontally such that for the horizontal deflection, the central beam is subjected to a greater deflection than side beams and for the vertical deflection, the side beams are subjected to a greater deflection than the central beam. Two vertical magnetic pole piece plates which are long vertically and thin horizontally are so disposed as to sandwich the central beam near the outlet of the central electron gun in order to weaken horizontal deflection magnetic field acting on the central beam, whereby a portion of the horizontal deflection magnetic flux acting on the central beam is absorbed by the two magnetic pole piece plates. The vertical deflection magnetic field is almost not affected by these vertical magnetic pole piece plates. Further, two horizontal magnetic pole piece plates which are long horizontally and short vertically are so disposed as to sandwich side beams near the outlets of the side electron guns in order to weaken vertical deflection magnetic fields acting on the side beams and to intensity vertical deflection magnetic fields acting on the central beam.

15 Claims, 14 Drawing Figures

COLOR PICTURE TUBE

This invention relates to color picture tubes and more particularly, it relates to a wide angle deflection in-line type color picture tube of a type which makes it possible to eliminate the convergence correcting circuit usually provided in the color television receiver set while also correcting upper and lower pincushion distortions.

In a typical prior art 90° in-line type color picture tube, the horizontal deflection magnetic field and the vertical deflection magnetic field are distorted intentionally to take the form of a pincushion magnetic field and a barrel magnetic field, as shown in FIG. 1, respectively, in order to ensure the convergence of both the side beams on the phosphor screen and to ensure the correction for upper and lower pincushion distortions. In FIG. 1, numerals 1, 2 and 3 respectively designate the left side beam, central beam and right side beam when the electron gun assembly is viewed from the phosphor screen. Under the application of the deflection magnetic field as shown in FIG. 1, the convergence for the side beams 1 and 3 can be obtained but the convergence of the central beam 2 with the side beams 1 and 3 is prevented, giving rise to a coma aberration, as shown in FIG. 2. As illustrated therein, an oblong pattern displayed by the central beam 2 corresponds to the dotted lines 4 and the same pattern displayed by the side beams 1 and 3 corresponds to solid lines 5. The displacement between the dotted line pattern and the solid line pattern becomes larger toward the periphery of the screen. The coma aberration is caused by the fact that the central beam 2 has less deflection degree than the side beams 1 and 3 especially at the tube neck side of a deflection yoke mounted on the color picture tube. More particularly, at the tube neck side of the deflection yoke, the central beam 2 is spaced apart horizontally from the side beams 1 and 3, that is individual beams are spaced, and vertical and horizontal deflection magnetic fields acting on the central beam 2 are less than those acting on the side beams 1 and 3, thereby leading to occurrence of the coma aberration as shown in FIG. 2.

Additionally, the amount of swelling of the deflection magnetic field becomes greater toward locations spaced apart from the central axis or Z-axis of the tube so that the pincushion distortion is affected by the deflection magnetic field at the tube fumel side of the deflection yoke mounted on the color picture tube. Since the horizontal deflection magnetic field takes the form of a pincushion magnetic field at the tube funnel side of the deflection yoke, upper and lower pincushion distortions can be corrected.

In order to correct the coma aberration, in the prior art 90° in-line type color picture tube, a magnetic field controlling device as shown in FIG. 3 is provided immediately after the electron beam outlets of the electron guns emitting beams of electrons which are deflected slightly in the direction perpendicular to the Z-axis. FIG. 3 shows a front view of the magnetic field controlling device. The magnetic field controlling device constituted by washers 6 and 7 and discs 8 and 9 made of high permeability material is secured by spot welding, for example, to a shield cap of non-magnetic material fixed on the glass wall of the color picture tube. In the figure, the two washers 6 and 7 serve to weaken the horizontal and vertical deflection magnetic fields near the outlets 11 and 13 for both the side beams and to intensify the vertical deflection magnetic field near an outlet 12 for the central beam. In addition, the two discs 8 and 9 serve to intensify the horizontal deflection magnetic field near the outlet 12 for the central beam. As a result, the deflection degree of both the side beams 1 and 3 becomes less than that of the central beam 2 and therefore, the poor deflection degree of the central beam due to the non-homogeneous deflection magnetic fields is corrected, thereby avoiding a pattern on the screen having coma aberration.

The provision of such a magnetic field controlling device as shown in FIG. 3 for the 90° in-line type color picture tube is disclosed in an article "New color picture tube system for portable TV receivers" by R. L. Barbin et al announced in IEEE Trans. BTR-18 No. 3.

Incidentally, since the pincushion distortion of a wide deflection color picture tube such as 110°-deflection type one, for example, is greater than that of a 90°-deflection type color picture tube, the horizontal deflection magnetic field for the former is designed to be a pincushion magnetic field more swelled than for the latter in order to eliminate a correction circuit for upper and lower pincushions. More particularly, in view of the above-mentioned phenomenon that the deflection magnetic field near the funnel of the tube has a larger influence upon the pincushion distortion on the funnel side of the deflection yoke than on the neck side thereof, the horizontal deflection magnetic field near the funnel side of the deflection yoke is designed to take a more intensified pincushion magnetic field as compared with the 90° deflection type color picture tube so that the upper and lower pincushion distortions may be corrected. On the other hand, the intensified pincushion magnetic field near the funnel side of the deflection yoke makes excessive the correction for convergence of the side beams 1 and 3 and, for reducing the excessive correction to a normal correction, a barrel magnetic field in contrast to the pincushion magnetic field is applied near the neck side of the deflection yoke. In this way, by making the horizontal deflection magnetic field more pincushion like near the funnel side of the deflection yoke and more barrel like near the neck side thereof, any correction circuit for upper and lower pincushion distortions can be eliminated and the convergence of the side beams 1 and 3 can be ensured even for the wide deflection type color picture tube. In this case, however, the coma aberration takes place as shown in FIG. 4 instead of FIG. 2. In FIG. 4, numeral 41 designates an oblong pattern displayed by means of the central beam and 42 an oblong pattern displayed by means of the side beams. Both the horizontal and vertical deflection magnetic fields near the neck side of the deflection yoke which have a large influence upon the coma aberration are of a barrel magnetic field. Now, consider a barrel magnetic field produced by two magnetic poles N and S. On a straight line across the magnetic poles N and S, the intensity of the magnetic field is minimized at the middle point and maximized toward the magnetic poles N and S. On the other hand, on a straight line perpendicular to the straight line mentioned just above and passing the middle point thereof, the intensity of magnetic field maximized at the middle point is reduced with departure therefrom. Consequently, the central beam 2 is deflected more greatly than the side beams 1 and 3 in terms of the horizontal deflection whereas the side beams 1 and 3 are deflected more greatly than the central beam 2 in terms of the vertical deflection. In other words, for both the vertical and horizontal deflections, the deflection degree of the side beams 1 and 3 is larger than that of the central beam 2 and a coma aberration caused thereby is different from that shown in FIG. 4 with the result that the magnetic field controlling device shown in FIG. 3 cannot be sufficient for a desired correction for coma aberration.

An object of this invention is to provide a color picture tube provided with a magnetic field controlling device which is capable of correcting the coma caused by the fact that the magnitudes of deflection degrees of the central beam and the side beams are different dependent on the vertical deflection or the horizontal deflection.

According to this invention, in an in-line type color picture tube provided with a deflection yoke, there is provided, near the beam outlets of the electron guns at which points leakage of deflection magnetic fields occurs, a magnetic field controlling device having influence upon one of the horizontal and vertical deflection magnetic fields and little influence upon the other deflection magnetic field, whereby the deflection degree of the central beam and that of the side beams are made equal for each of the horizontal and vertical deflections. The magnetic field controlling device comprises magnetic pole piece elements of a geometrical structure which are positioned with their long dimension in the direction perpendicular to the deflection direction in which the influence of the device occurs and their short dimension in the direction perpendicular to the deflection direction in which the influence of the device does not occur. In order that the deflection degree of one beam is intensified in relation to that of the other beam, the magnetic flux interlinked with the one beam is increased or the magnetic flux interlinked with the other beam is reduced by means of the magnetic field controlling device. For the horizontal deflection, in order to intensify the deflection degree of the one beam more than that of the other beam, magnetic field controlling elements which are long vertically and short horizontally are respectively disposed above and below the beam which is intended to subject to an intensified deflection degree so that the magnetic flux to be interlinked with this beam is concentrated to this beam position, thereby intensifying the deflection magnetic field acting on this beam. Alternatively, the magnetic field controlling elements which are long vertically and short horizontally are respectively disposed on the right and left sides of the beam which is intended to be subject to a relatively weak deflection degree so that the magnetic flux which would be interlinked with this beam is absorbed by the magnetic field controlling elements, thereby weakening the deflection magnetic field acting on this beam. For the vertical deflection, magnetic field controlling elements which are long horizontally and short vertically are respectively disposed above and below the beam which is intended to subject to a weak deflection degree so that the magnetic flux to be interlinked with this beam is absorbed by the magnetic field controlling elements, thereby weakening the deflection magnetic field acting on this beam.

Other objects and advantages of this invention will become apparent from the following detailed description taken in conjunction with the accompanying drawings in which:

FIG. 5 is a perspective view, as viewed from front and left above, of a magnetic field controlling device provided for a color picture tube according to this invention.

Figure 5:
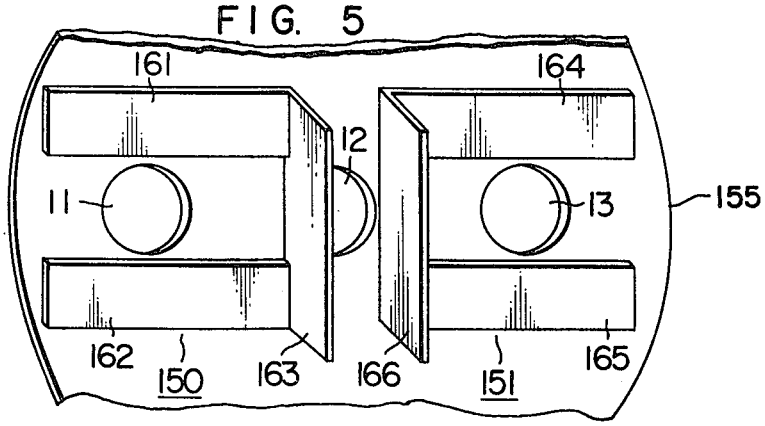
FIG. 5 is a perspective view of one example of magnetic field controlling device used for a color picture tube according to this invention.
Figure 6:
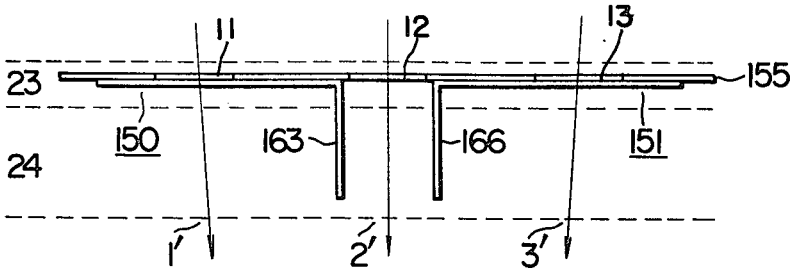
FIG. 6 is a plan view of FIG. 5.

As shown in FIG. 5, magnetic field controlling elements 150 and 151 made of magnetic material have a symmetric configuration and are disposed symmetrically with respect to a central beam 2. The magnetic field controlling element 150 includes three thin magnetic pole piece plates. First and second magnetic pole piece plates 161 and 162 are disposed to sandwich a side beam 1 vertically, and they are long horizontally and short vertically. A third magnetic pole piece plate 163 which is long vertically and short back and forth is disposed to separate the side beam 1 from the central beam 2. The first and second magnetic pole piece plates 161 and 162 are connected with the third magnetic pole piece plate 163 at the upper and lower portions thereof, respectively. On the other hand, the magnetic field controlling element 151 includes first, second and third magnetic pole piece plates 164, 165 and 166 which are correspondingly symmetrical with the first, second and third magnetic pole piece plates 161, 162 and 163. The magnetic field controlling elements 150 and 151 are secured to a non-magnetic body 155, a portion of which is seen in FIG. 5. In FIG. 6, arrows 1', 2' and 3' show directions in which beams 1, 2 and 3 travel, and the magnetic field controlling device is illustrated as being secured to a shield cap of non-magnetic material a portion of which is designated at 155.

When considering the horizontal deflection magnetic field, a portion of magnetic flux which would interlink with the central beam 2 in the absence of the vertically long magnetic pole piece plates 163 and 166 passes through the magnetic pole piece plates 163 and 166 of high permeability, that is, the magnetic flux which would interlink with the central beam 2 is admitted to the magnetic pole piece plates 163 and 166 and reduced thereby so that the horizontal deflection magnetic field acting on the central beam 2 is weakened. The horizontal deflection magnetic flux interlinked with the side beams 1 and 2 remains substantially unchanged because the side beams 1 and 2 are spaced apart from the magnetic pole piece plates 163 and 166. Further, since the magnetic pole piece plates 161, 162, 164 and 165 are short vertically and long horizontally, the presence or absence of these magnetic pole piece plates has little influence upon the horizontal deflection magnetic flux interlinked with the side beams 1 and 3. Accordingly, the magnetic field controlling elements 150 and 151 reduces the horizontal deflection magnetic flux acting on the central beam 2, thereby weakening the horizontal deflection magnetic field acting on the central beam 2 in relation to the horizontal deflection magnetic fields acting on the side beams 1 and 3. As a result, the horizontal coma as shown in FIG. 4 can be corrected.

Figure 7:
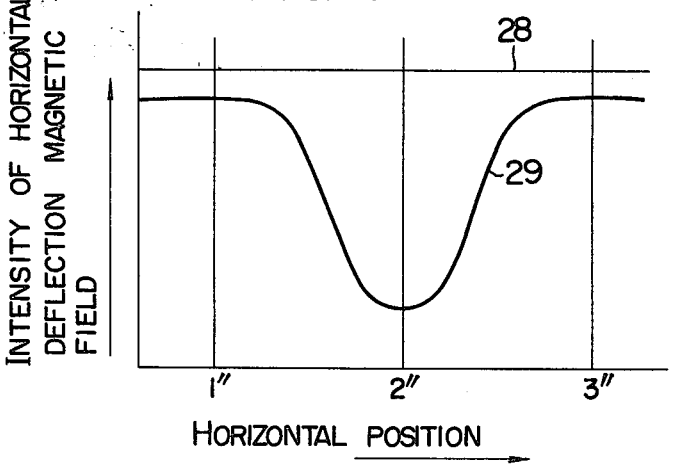
FIG. 7 is a graph showing the relation between horizontal position and intensity of the horizontal deflection magnetic field.

FIG. 7 shows one example of the relation between horizontal position and intensity of the horizontal deflection magnetic field. In the figure, the abscissa represents variation in position in the horizontal direction, that is perpendicular to the Z-axis, within a space 24 in which the magnetic pole piece plates 163 and 166 are contained. Positions 1'', 2'' and 3'' correspond to centers of the beam outlets 11, 12 and 13. When it is assumed that the horizontal deflection magnetic field is a homogeneous magnetic field designated at 28 in the absence of the magnetic field controlling elements 150 and 151, the presence of the magnetic field controlling elements 150 and 151 creates a horizontal deflection magnetic field intensity distribution as designated at 29 wherein the intensity of the magnetic field at the position 2'' is weakened in relation to the intensities of the magnetic field at the positions 1'' and 3''. As will be seen from FIG. 7, the horizontal deflection magnetic fields near the side beam outlets 11 and 13 are reduced as compared with the horizontal deflection magnetic field 28 because portions of the horizontal deflection magnetic flux which would pass through the paired magnetic pole piece plates 161 and 162 and the other paired magnetic pole piece plates 164 and 165, respectively, are admitted to the magnetic pole piece plates 163 and 166. However, the magnetic pole piece plates 161, 162, 164 and 165 which are short vertically will suppress such a reduction to a small extent.

Next, when considering the vertical deflection magnetic field, the vertical deflection magnetic flux which would pass near the side beam outlets 11 and 13 in the absence of the magnetic pole piece plates 161, 162, 164 and 165 mostly passes through the magnetic pole piece plates 161, 162, 164 and 165 of high permeability so that the vertical deflection magnetic fields near the side beam outlets 11 and 13 are weakened as compared with the case where the magnetic pole piece plates 161, 162, 164 and 165 are not provided. In addition, since the vertical deflection magnetic flux once absorbed by the magnetic pole piece plates 164 and 165 is transmitted to the magnetic pole piece plates 161 and 162 through a space within which the central beam outlet is located, the vertical deflection magnetic field near the central beam outlet 12 is intensified as compared with the case where the magnetic pole piece plates 161, 162, 164 and 165 are not provided.

Figure 1:
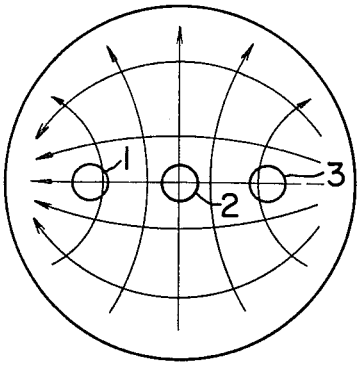
FIG. 1 PRIOR ART
FIG. 1 is a diagrammatic representation showing deflection magnetic fields in a prior art 90° deflection in-line type color picture tube.
Figure 2:
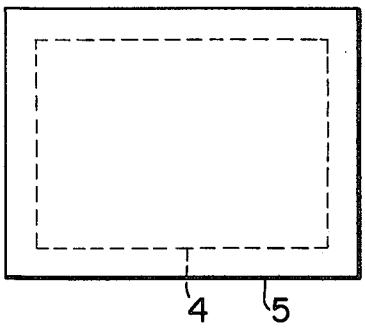
FIG. 2 PRIOR ART
FIG. 2 is a diagramatic representation showing a pattern of coma due to the deflection magnetic fields of FIG. 1.
Figure 3:
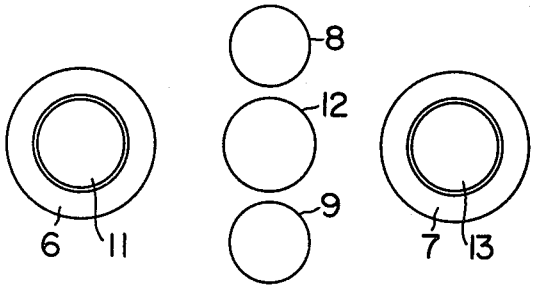
FIG. 3 PRIOR ART
FIG. 3 is a front view of a magnetic field controlling device conventionally used for correcting the coma of FIG. 2.
Figure 4:
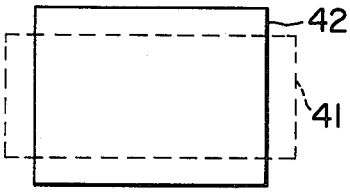
FIG. 4 PRIOR ART
FIG. 4 is a diagrammatic representation showing a pattern of coma due to a wide angle deflection magnetic field caused with the magnetic field controlling device of FIG. 3.

Accordingly, the magnetic pole piece plates 161, 162, 164 and 165 serve to weaken the vertical deflection degree of the side beams 1 and 3 but intensify the vertical deflection degree of the central beam 2, thereby correcting the vertical coma as shown in FIG. 4.

Figure 8:
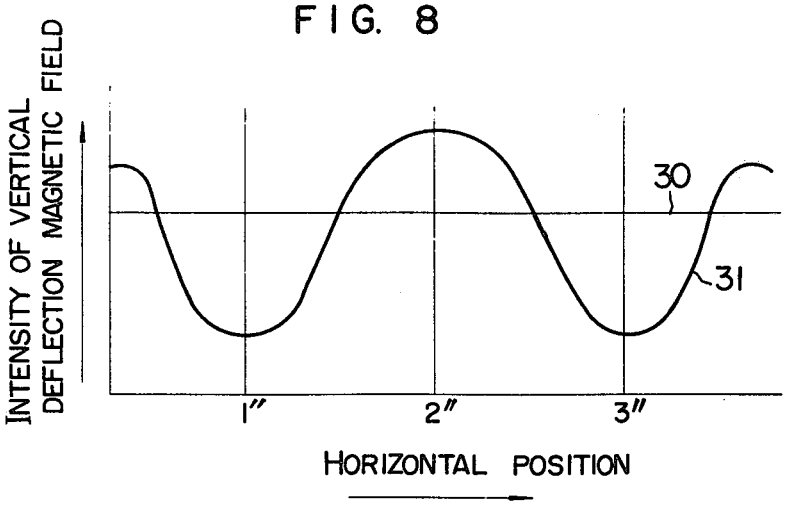
FIG. 8 is a graph showing the relation between horizontal position and intensity of the vertical deflection magnetic field.

FIG. 8 shows one example of the relation between horizontal position and intensity of the vertical deflection magnetic field. In the figure, abscissa represents variation in position in the horizontal direction, that is perpendicular to the Z-axis, within a space 23 in which the magnetic pole piece plates 161, 162, 164 and 165 are contained.

The vertical deflection magnetic flux which would assume a homogeneous magnetic field designated at 30 in the absence of the magnetic pole piece plates 161, 162, 164 and 165 is once absorbed by the magnetic pole piece plates 164 and 165 and transmitted to the magnetic pole piece plates 161 and 162 through the space so that the intensity of magnetic field changes as designated at a curve 31. The intensity of magnetic field is weakened near the side beam outlets 11 and 13 at which the vertical deflection magnetic flux is absorbed but intensified near the central beam outlet 12 at which the vertical deflection magnetic flux is emitted.

It is noted that the magnetic pole piece plates 163 and 166 which are thin horizontally have little influence on the vertical deflection magnetic field.

Figure 9:
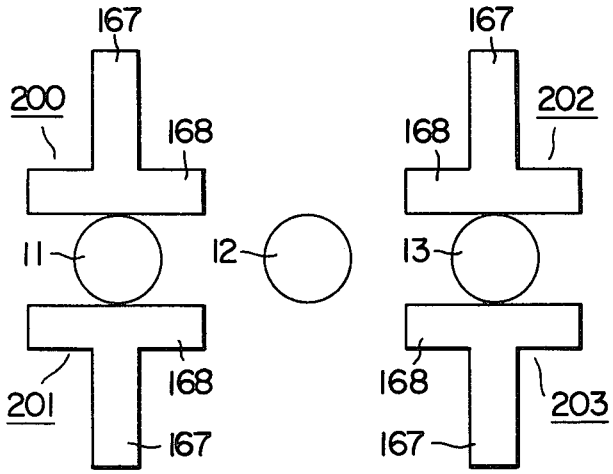
FIG. 9 is a front view of another example of magnetic field controlling device capable of correcting the coma of FIG. 4.

FIG. 9 shows a front view of another embodiment of a magnetic field controlling device utilized for a color picture tube according to this invention.

Magnetic field controlling elements 200 to 203 each include a magnetic pole piece plate 167 which is long vertically and a magnetic pole piece plate 168 which is long horizontally, and they are disposed vertically and symmetrically with respect to the side beam outlets 11 and 13.

The horizontally long magnetic pole piece plate 168 of respective magnetic field controlling elements 200 to 203 performs the same function as the magnetic pole piece plates 161, 162, 164 and 165 shown in FIG. 5, intensifying the vertical deflection magnetic field for the central beam 2 and weakening the vertical deflection magnetic fields for the side beams 1 and 3. The magnetic pole piece plate 167 which is short horizontally has little influence on the vertical deflection magnetic field.

When considering the horizontal deflection magnetic field, since the horizontal deflection magnetic flux once absorbed by the upper magnetic pole piece plate 167 which is long vertically is emitted to a space in which the side beam outlet 11 (and 13) is located and then absorbed by the lower magnetic pole piece plate 167, the horizontal deflection magnetic fields near the side beam outlets 11 and 13 are intensified. On the other hand, the horizontal deflection magnetic field near the central beam outlet 12 is spaced apart from the magnetic pole piece plate 167 and therefore, remains substantially unchanged. Accordingly, the horizontal deflection magnetic field for the central beam 2 is weakened in relation to the horizontal deflection magnetic fields for the side beams 1 and 3.

Figure 10:
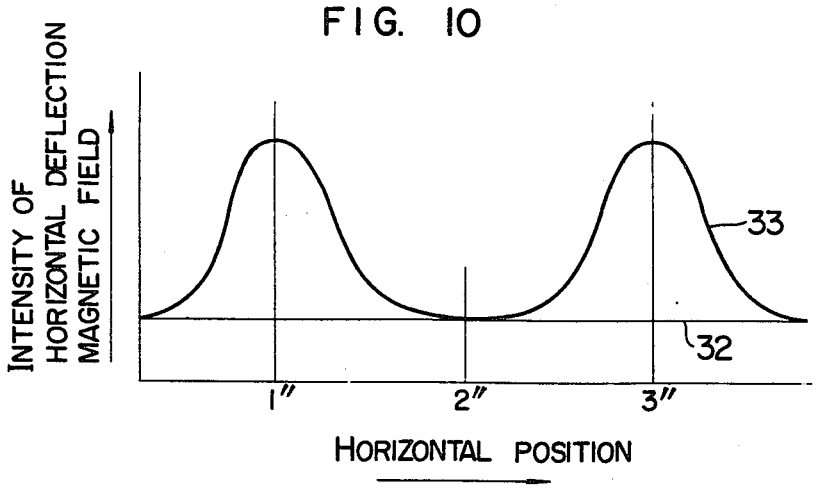
FIG. 10 is a graph showing the relation between horizontal position and intensity of the horizontal deflection magnetic field obtainable with the magnetic field controlling device of FIG. 9.

FIG. 10 shows one example of the relation between horizontal position and the intensity of the horizontal deflection magnetic field obtainable with the magnetic field controlling elements 200 to 203. The horizontal deflection magnetic field which would assume a homogeneous magnetic field as designated at 32 is intensified by the magnetic field controlling elements 200 to 203 near the side beam outlets as illustrated by a curve 33.

Figure 11:
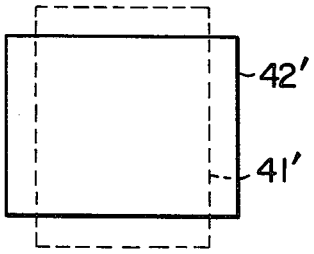
FIG. 11 is a diagrammatic representation showing a pattern of another coma.
Figure 12:
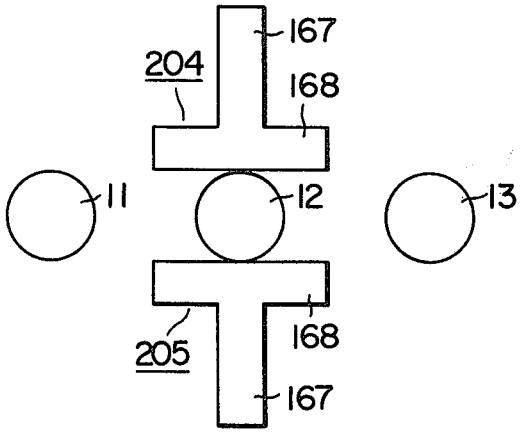
FIG. 12 is a front view of a magnetic field controlling device capable of correcting the coma of FIG. 11.

FIG. 11 shows a coma caused by the fact that the vertical deflection degree of the central beam 2 is greater than that of the side beams 1 and 3 whereas the horizontal deflection degree of the side beams 1 and 3 is greater than that of the central beam 2. In the figure, an oblong pattern 41' corresponds to the central beam 2 and an oblong pattern 42' corresponds to the side beams 1 and 3. This coma occurs when the magnitudes of the vertical and horizontal deflection magnetic fields for the side beams and the central beam are reversed as compared to the foregoing case. Therefore, the correction therefor may be performed in a reversed manner. FIG. 12 shows one example of a magnetic field controlling device for correcting the coma of FIG. 11. In the case of FIG. 12, the magnetic pole piece plate 167 has little influence upon the magnetic field near the side beam outlets 11 and 13 but intensifies the horizontal deflection magnetic field near the central beam outlet 12. On the other hand, the magnetic pole piece plate 168 weakens the vertical deflection magnetic field near the central beam outlet 12 and intensifies the vertical deflection magnetic fields near the side beam outlets 11 and 13.

Accordingly, the magnetic field controlling elements 204 and 205 of FIG. 12 can correct the coma shown in FIG. 11.

Figure 13:
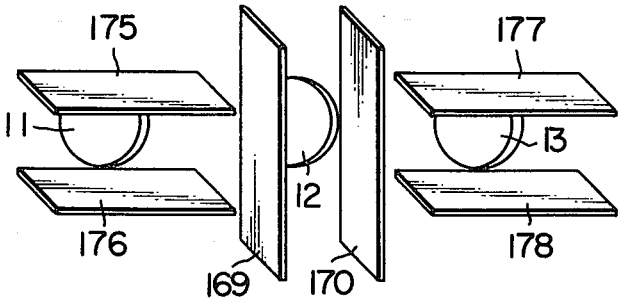
FIG. 13 is a perspective view of another magnetic field controlling device capable of correcting the coma of FIG. 4.
Figure 14:
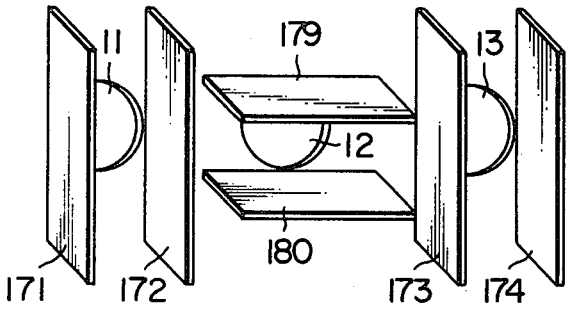
FIG. 14 is a perspective view of another magnetic field controlling device capable of correcting the coma of FIG. 11.

Magnetic field controlling devices shown in FIGS. 13 and 14 are for correcting the comas of FIGS. 4 and 11, respectively.

Comas mentioned just above can be corrected based on the fact that magnetic pole piece plates 169 to 174 which are long vertically and short horizontally have little influence upon the vertical deflection magnetic field but have influence upon the horizontal deflection magnetic field whereas magnetic pole piece plates 175 to 180 which are long horizontally and short vertically have little influence upon the horizontal deflection magnetic field but have influence upon the vertical deflection magnetic field. The coma correction ability of the magnetic pole piece plates 169 to 180 is easily seen from the foregoing description and a description thereof is omitted.

It is noted that the intensity of horizontal deflection magnetic field depends on the vertical length or Z-axis direction length of the magnetic pole piece plates 163, 166, 168 and 169 to 174 which are long vertically. Further, it is noted that the intensity of vertical deflection magnetic field depends on the horizontal length of the magnetic pole piece plates 161, 162, 164, 165, 167 and 175 to 180 which are long horizontally. Accordingly, a proper amount of correction for coma can be accomplished by adjusting the length of the magnetic pole piece plates 161 to 180 in the required direction.

What is claimed is:

1. A color picture tube device comprising:

a color picture tube having a target and three electron guns aligned in line so as to provide a pair of side electron guns and a center electron gun producing three electron beams directed to said target;

deflecting means coupled to said color picture tube for simultaneously generating a first deflection magnetic field for deflecting beams of electrons emitted from said electron guns in a first direction and a second deflection magnetic field for deflecting said beams of electrons in a second direction substantially perpendicular to said first direction so as to scan said target, said deflecting means producing such a first distribution of deflection magnetic field in the first direction that the side beams emitted from the side electron guns are deflected more greatly than the central beam emitted from the center electron gun and a second distribution of deflection magnetic field in the second direction such that the central beam is deflected more greatly than the side beams;

first magnetic field modifying means disposed in a space downstream of the electron guns in which the deflection magnetic fields prevail for causing the deflection magnetic field in the first direction acting on the side beams to be relatively weakened in relation to that acting on the central beam; and second magnetic field modifying means disposed in said space for causing the deflection magnetic field in the second direction acting on the central beam to be weakened in relation to that acting on the side beams.

2. A color picture tube device according to claim 1, in which said three electron guns aligned in said first direction as a horizontal line perpendicular to a vertical line corresponding to said second direction.

3. A color picture tube device according to claim 2, in which said first magnetic field modifying means comprises a pair of first and second elongated magnetic plates disposed on the opposite sides of each of said side beams in said second direction, said plates being positioned with the long dimension thereof directed in said second direction.

4. A color picture tube device according to claim 2, in which said first magnetic field modifying means comprises a pair of first and second elongated magnetic plates disposed on the opposite sides of each of said side beams in said second direction, said plates being positioned with the long dimension thereof directed in said first direction.

5. A color picture tube device according to claim 4, in which said second magnetic field modifying means is composed of two pair of magnetic plates having planes perpendicular to said first direction, and each of said pair of magnetic plates is aligned in said second direction on a line passing through each of said side beams.

6. A color picture tube device according to claim 4, in which said second magnetic field modifying means comprises a pair of third and fourth elongated magnetic plates disposed on the opposite sides of said central beam in said first direction between said sided beams and said central beam, the plane of said plates being perpendicular to said first direction.

7. A color picture tube device according to claim 6, in which the plane of said first and second magnetic plates is in said first direction and the plane of said third and fourth magnetic plates is in said second direction.

8. A color picture tube device according to claim 6, further comprising a non-magnetic member mounted at the inner wall of said color picture tube and having holes through which the respective beams are passed, wherein said first, second, third, and fourth magnetic plates are mounted on said non-magnetic member.

9. A color picture tube device according to claim 6, in which the plane of said third and fourth magnetic plates is in said first direction.

10. A color picture tube device according to claim 6, in which the plane of said first and second magnetic plates is in said second direction, and the plane of said third and fourth magnetic plates is parallel to the beam advancing direction.

11. A color picture tube device according to claim 10, in which one of said third and fourth magnetic plates is integrally constructed with one of said first and second magnetic plates, and the other of said third and fourth magnetic plates is integrally constructed with the other of said first and second magnetic plates.

12. A color picture tube device according to claim 10, further comprising a non-magnetic member mounted at the inner wall of said color picture tube and having holes through which the respective beams are passed, wherein said first, second, third, and fourth magnetic plates are mounted on said non-magnetic member.

13. In a color picture tube device comprising an in-line color picture tube having three electron guns aligned in line and a deflection means positioned around said tube for causing horizontal and vertical deflection magnetic fields to scan a raster with three beams produced by said three electron guns on a viewing screen of said tube, said horizontal deflection magnetic field deflecting horizontally the central beam more greatly than the two side beams produced by said electron guns and said vertical deflection magnetic field deflecting vertically the two side beams more greatly than the central beam produced by said electron guns, an improvement comprising a first set of high-magnetic permeable material plates elongated in the vertical direction and provided on opposite sides of the central beam in said horizontal deflection magnetic field in spaced parallel planes so as to face each other in the horizontal direction and two pair of second high-magnetic permeable material plates elongated in the horizontal direction and provided above and below the two side beams in said vertical deflection magnetic field.

14. A color picture tube device according to claim 13, in which said second plates on either side of said side beams lie in spaced parallel planes.

15. A color picture tube device according to claim 13, in which said second plates on either side of said side beams are in coplanar relationships.

* * * * *